US010506886B1

(12) United States Patent
Winters

(10) Patent No.: US 10,506,886 B1
(45) Date of Patent: Dec. 17, 2019

(54) TRIM AND MOLDING SUPPORT SYSTEM AND RELATED METHODS

(71) Applicant: David Winters, Deland, FL (US)

(72) Inventor: David Winters, Deland, FL (US)

( * ) Notice: Subject to any disclaimer, the term of this patent is extended or adjusted under 35 U.S.C. 154(b) by 0 days.

(21) Appl. No.: 15/866,720

(22) Filed: Jan. 10, 2018

Related U.S. Application Data

(60) Provisional application No. 62/444,956, filed on Jan. 11, 2017.

(51) Int. Cl.
*A47F 7/00* (2006.01)
*A47F 5/10* (2006.01)

(52) U.S. Cl.
CPC ..... *A47F 7/0035* (2013.01); *A47F 5/108* (2013.01)

(58) Field of Classification Search
CPC ..... A47F 7/0035; A47F 5/108; A47F 5/02; A47B 43/00; A47B 61/003; A47B 97/04; A47B 97/08
USPC ..... 211/60.1
See application file for complete search history.

(56) References Cited

U.S. PATENT DOCUMENTS 445,633 A * 2/1891 Becker ..... F16M 11/00 248/165
3,310,180 A * 3/1967 Neagle ..... A47G 25/0664 211/189
5,236,095 A * 8/1993 Krizka ..... A47F 5/13 211/102
5,422,638 A * 6/1995 Singer ..... G08G 1/095 116/63 P
5,549,072 A * 8/1996 Maloney ..... A47C 7/004 114/363
5,848,716 A * 12/1998 Waranius ..... A47B 81/005 211/189
7,013,885 B2 * 3/2006 Czajkoski ..... F24B 1/182 126/30
7,470,843 B2 * 12/2008 Hsieh ..... G10G 5/00 84/327
8,151,784 B2 * 4/2012 Czajkoski ..... F24B 1/182 126/25 A
9,010,312 B1 * 4/2015 Rinderle ..... A47J 33/00 126/30
9,380,890 B2 * 7/2016 Mustari ..... A47F 5/02
9,603,469 B2 * 3/2017 Lapointe ..... A01G 5/04
2005/0011847 A1 * 1/2005 Goodwin ..... A47F 5/04 211/196
2006/0054576 A1 * 3/2006 Durham ..... A47L 23/205 211/85.7
2014/0291540 A1 * 10/2014 Sakuragi ..... A61B 6/4405 250/393

(Continued)

FOREIGN PATENT DOCUMENTS

WO WO-2008066396 A1 * 6/2008 ..... E04H 12/2238

*Primary Examiner* — Ko H Chan
(74) *Attorney, Agent, or Firm* — Allen Dyer Doppelt & Gilchrist PA

(57) ABSTRACT

A trim and molding support assembly includes an upright member and a collapsible leg arrangement connected to a lower end of the upright member. The collapsible leg arrangement includes a plurality of support legs and having expanded and collapsed positions. At least a first support arm extends outwardly from the upright member above the collapsible leg arrangement. With the collapsible leg arrangement in the collapsed position, the plurality of support legs and the first arm all extend from a common side of the upright member.

13 Claims, 8 Drawing Sheets

(56) References Cited

U.S. PATENT DOCUMENTS

2017/0154524 A1* 6/2017 Beaulieu ..... G08G 1/0955

* cited by examiner

TRIM AND MOLDING SUPPORT SYSTEM AND RELATED METHODS

CROSS-REFERENCE TO RELATED APPLICATION

The present application claims the benefit of U.S. Provisional Patent Application Ser. No. 62/444,956, filed on Jan. 11, 2017, the contents of which are herein incorporated by reference in their entirety.

FIELD OF THE INVENTION

The present invention relates to construction, and more particularly, to systems and methods for staging trim and molding at job sites.

BACKGROUND OF THE INVENTION

Trim and molding pieces are frequently delivered in bulk to a job site at some point prior to the finishing phase to make them available to the finish carpenters as needed. Conventionally, the trim and molding pieces are stacked on the floor of a garage or other suitable room of the building under construction. While this approach has sufficed for decades, improvements are possible.

SUMMARY OF THE INVENTION

In view of the foregoing, it is an object of the present invention to provide an improved trim and molding support system and related methods. According to one embodiment of the present invention, a trim and molding support assembly includes an upright member and a collapsible leg arrangement connected to a lower end of the upright member. The collapsible leg arrangement includes a plurality of support legs and having expanded and collapsed positions. At least a first support arm extends outwardly from the upright member above the collapsible leg arrangement. With the collapsible leg arrangement in the collapsed position, the plurality of support legs and the first arm all extend from a common side of the upright member.

According to another embodiment of the present invention, a method of holding and organizing trim molding pieces using a plurality of collapsible trim and molding support assemblies includes setting up a plurality of collapsed trim and molding support assemblies in respective expanded positions and aligning the plurality of the trim and molding support assemblies on an underlying surface. A plurality of trim and molding pieces are placed on the respective at least the first support arm and one or more support legs of the leg arrangement of the aligned support assemblies.

These and other objects, aspects and advantages of the present invention will be better appreciated in view of the drawings and following detailed description of preferred embodiments.

DETAILED DESCRIPTION OF PREFERRED EMBODIMENTS

Figure 1:
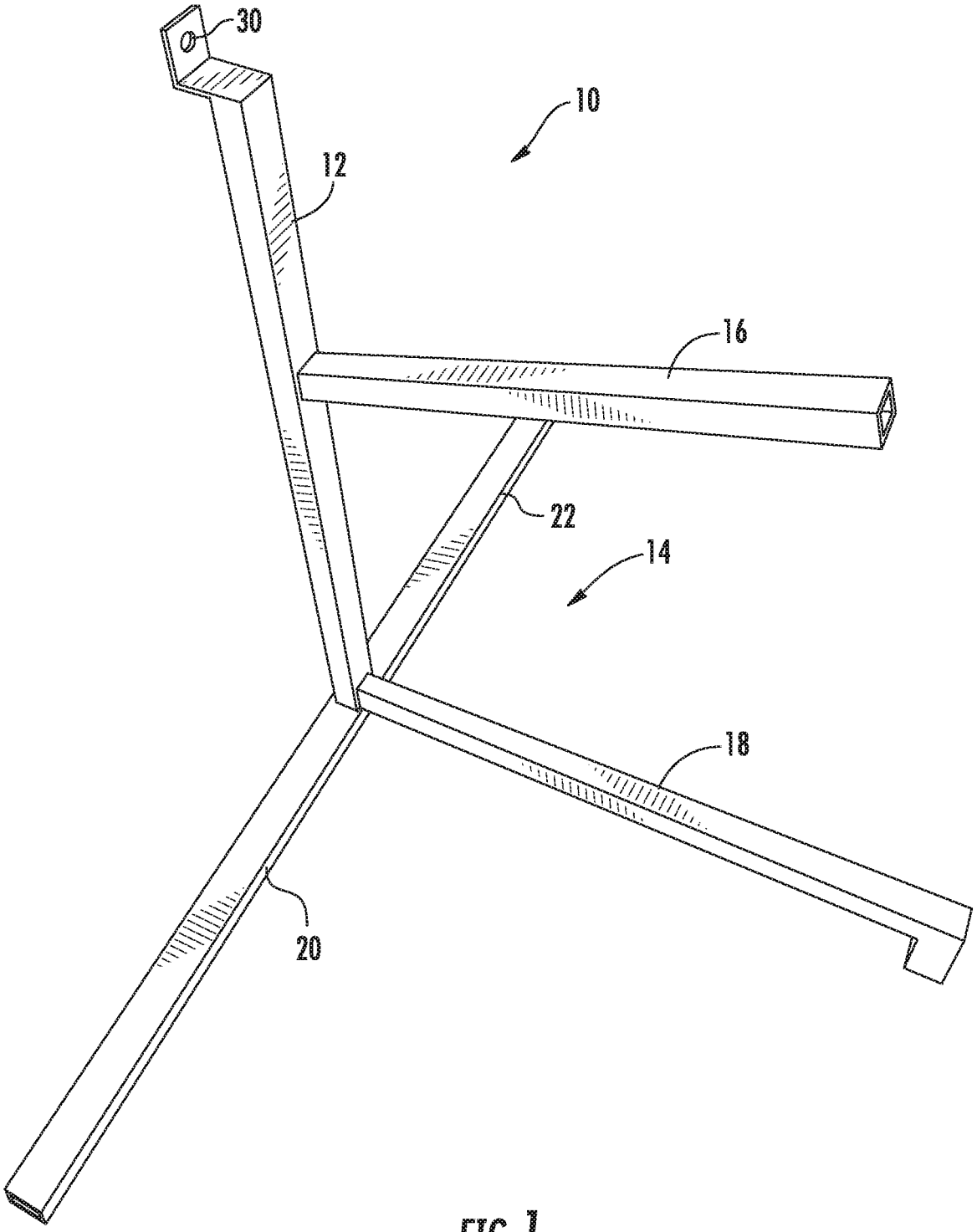
FIG. 1 is a perspective view of a collapsible support assembly, according to one embodiment of the present invention.

Referring to FIG. 1, a collapsible support assembly 10 includes an upright member 12 and a collapsible leg arrangement 14 connected to a lower end of the upright member 12. At least a first support arm 16 extends outwardly from the upright member 12 above the collapsible leg arrangement 14. The collapsible leg arrangement 14 includes a plurality of support legs and having expanded and collapsed positions.

In the embodiment depicted in FIG. 1, the collapsible leg arrangement 14 includes a first leg 18, a second leg 20, a third leg 22 and one support arm 16. In a preferred embodiment, the first support leg 18 and the first support arm 16 are permanently fixed to extend from a common side the upright member 12. The second and third support legs 20 and 22 are movable to extend from other sides of the upright member 12 in the expanded position. The second and third legs 20 and 22 are preferably rotatable relative to the upright member 12 and the first leg 18.

The first leg 18 includes a first foot 26 that descends downward from the end of the first leg 18 and is dimensioned vertically to accommodate the heights of the second and third legs 20 and 22. The second leg 22 includes a second foot 28 that descends downward from an end of the second leg 22. The second foot 28 is dimensioned vertically to accommodate the height of the third leg 22, which is footless.

As seen in FIG. 1, a wall fixation bracket 30 is arranged at the top of the upright member 12. The collapsible support assembly 10 can thus be configured for use adjacent to a wall, allowing the wall fixation bracket 30 to be temporarily secured to the wall. In this configuration, the second and third legs 20 and 22 are rotated to extend directly away from one another, approximately parallel to the wall and perpendicular to the first leg 18. To accommodate any installed kickboard or other wall trim, the fixation bracket 30 is advantageously mounted so as to extend rearward of the upright member 12.

Figure 2:
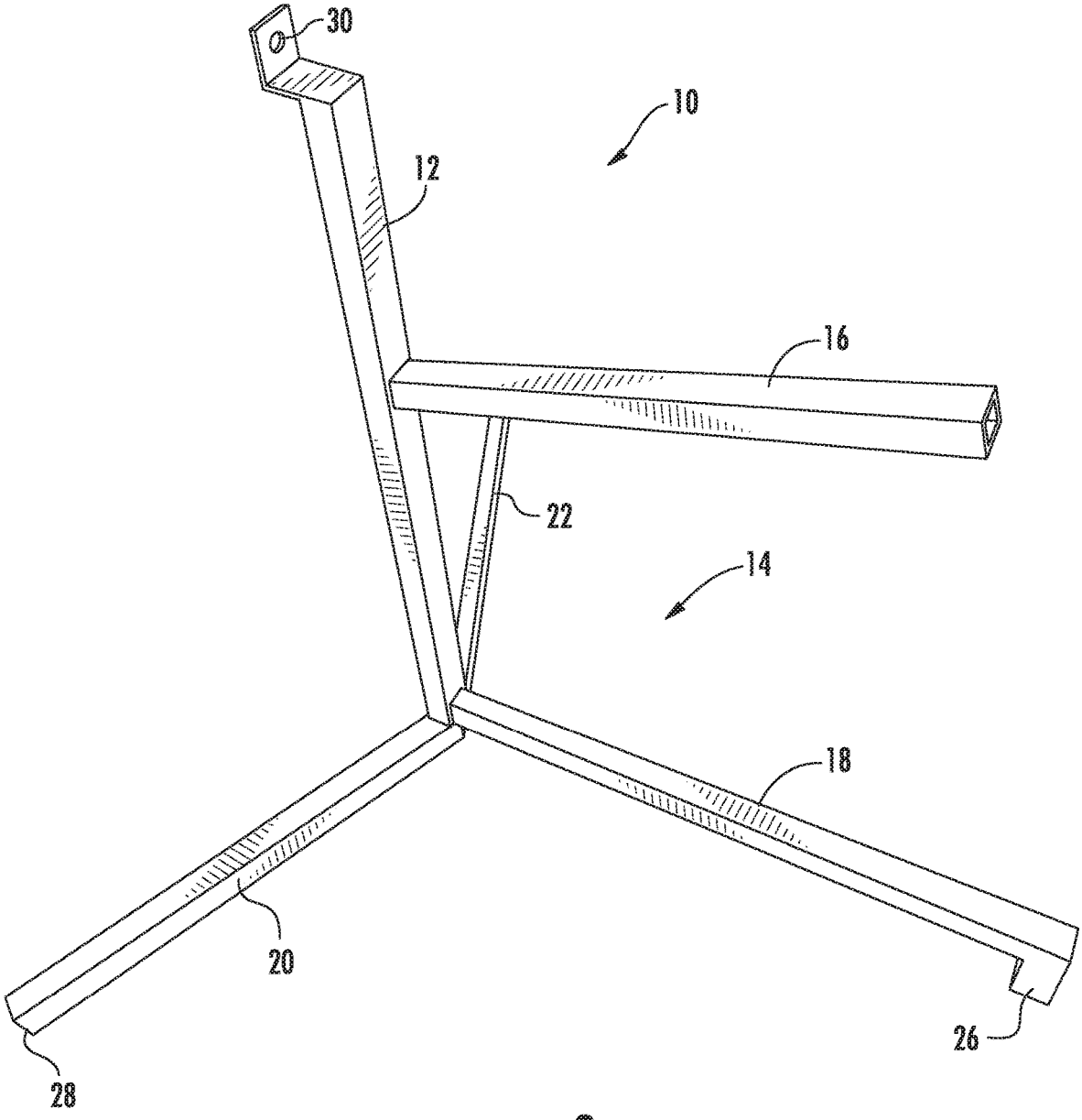
FIG. 2 is a perspective view of the collapsible support assembly of FIG. 1, in an alternate expanded position.

Referring to FIG. 2, the support assembly 10 can also be configured to be freestanding. In this alternative configuration, the second and third legs 20 and 22 are rotated approximately 120 degrees behind opposite sides of the first leg 18 to form an approximately 120 degree angle between the first, second and third legs 18, 20 and 22. In this configuration, the collapsible assembly 10 does not have to be affixed a wall but will be freestanding.

Figure 3:
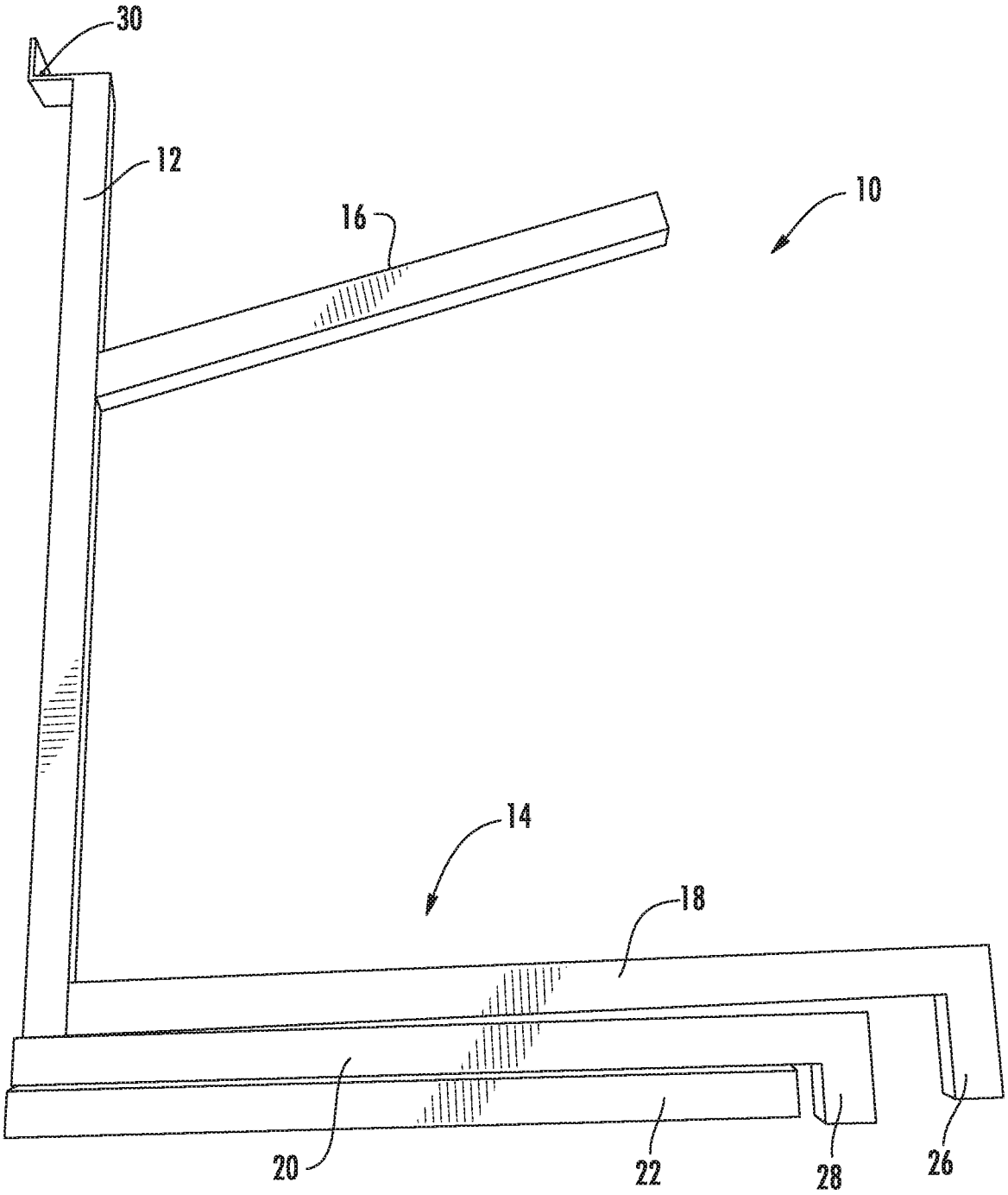
FIG. 3 is a side view of the collapsible support assembly of FIG. 1, in a collapsed position.

Referring to FIG. 3, the second and third support legs 20 and 22, when in a collapsed configuration, are rotated relative to the upright member 12 and toward the first support leg 18 until the second and third support legs 20 and 22 are nested under the first support leg in the collapsed position. When the collapsible leg arrangement 14 in the collapsed position, the plurality of support legs 18, 20 and 22 and the first arm 16 all extend from a common side of the upright member 12 and three support legs are nested under one another in a same plane. Specifically, the second support leg 20 is under the first support leg 18 and the third support leg 22 is under the second support leg 20. Thus, the support assembly 10 can be collapsed into a relatively flat configuration for ease of transport and storage.

Figure 4:
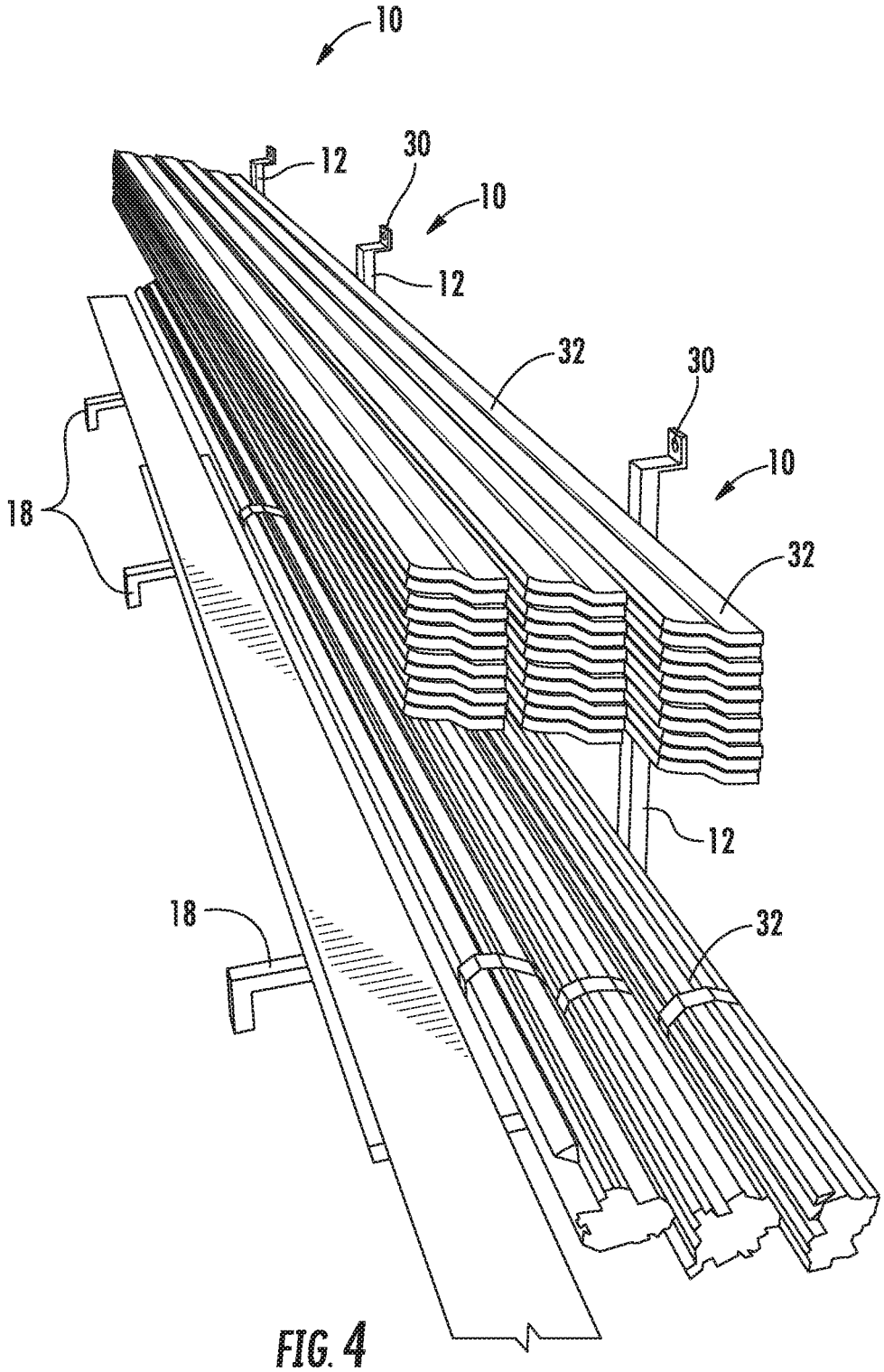
FIG. 4 is perspective view of a plurality of support assemblies of FIG. 1 in alignment to support a plurality of trim and molding pieces.

Referring to FIG. 4, a plurality of collapsible support assemblies 10 are aligned in working configuration in use. The plurality of support assemblies 10 are preferably substantially identical and are aligned so as to support a plurality of elongated trim and molding pieces 32 at one or more levels elevated above an underlying floor. In the depicted embodiment, the plurality of trim and molding pieces 32 are positioned on respective support arms 22 and support legs 18.

Figure 5:
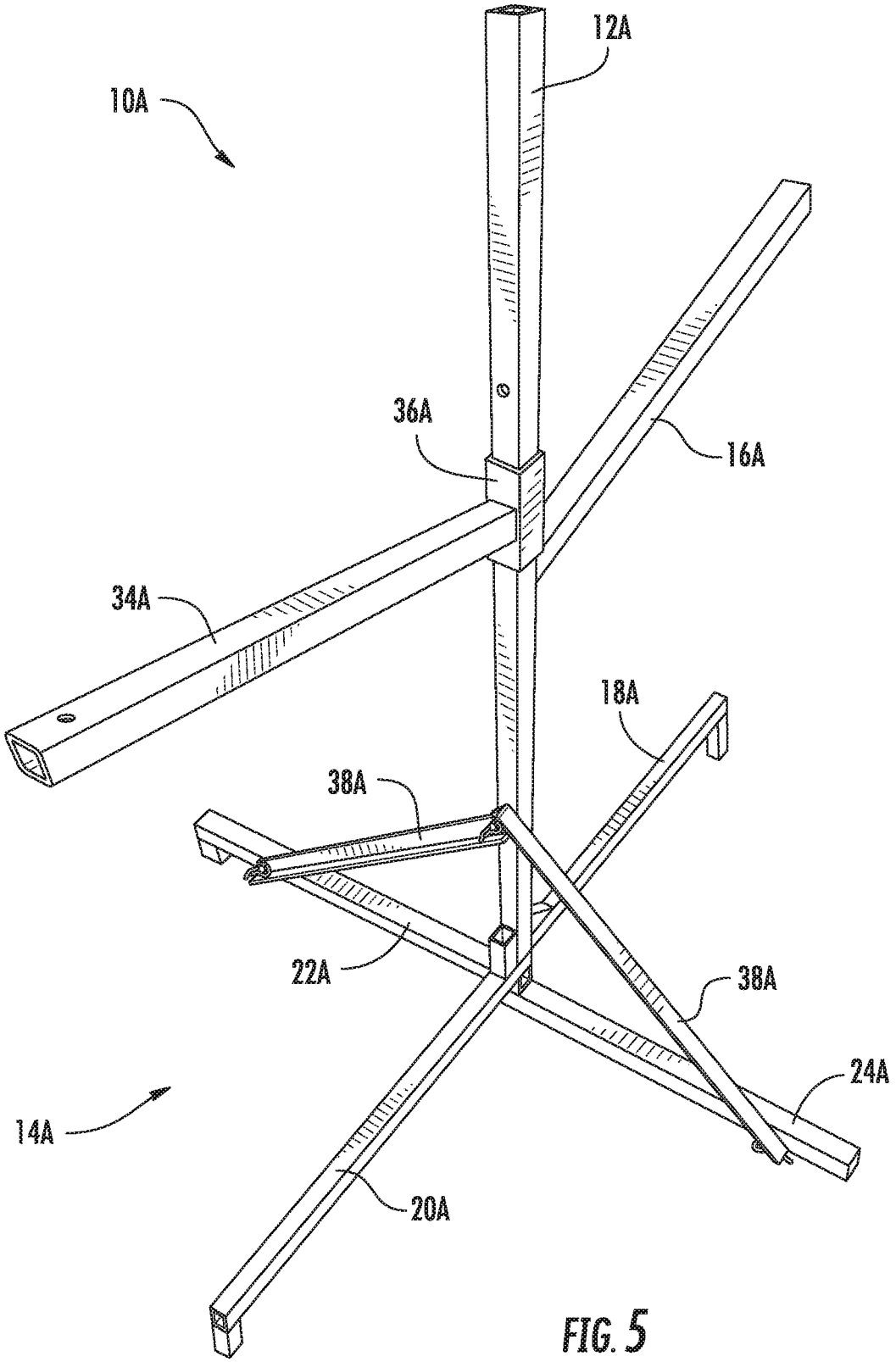
FIG. 5 is a first perspective view of a collapsible support assembly, according to another embodiment of the present invention.

Referring to FIG. 5, according to another embodiment of the present invention, the collapsible leg arrangement 14A of the collapsible trim and molding assembly 10A includes a first leg 18A, a second leg 20A and a third leg 22A and a fourth leg 24A.

The first leg 18A is preferably fixed and extends from the upright member 12A in the same direction as the support arm 16A. The second, third and fourth legs 20A, 22A and 24A are preferably rotatable relative to the upright member 12A and the first leg 18A. Specifically, the fourth leg 24A is rotatably connected to the upright member 12A and under the third support leg 22A, and the third support leg 22A is rotatable relative to the upright member 12A and under the second support leg 20A, and the second support leg 20A is rotatably connected to the upright member 12A under the first support leg 18A. The first leg 18A is separated from each of the third and fourth legs 22A and 24A by an approximately 90 degree angle in an expanded configuration. The second leg 20A extends opposite the first leg 18A and is likewise separated from each of the third and fourth legs 22A and 24A by an approximately 90 degree angle.

The first leg 18A includes a first foot 26A that descends downward from the end of the first leg 18A and is dimensioned vertically to accommodate the heights of the second, third and fourth legs 20A, 22A and 24A. The second leg 14A includes a second foot 28A that descends downward from an end of the second leg 20A. The second foot 28A is dimensioned vertically to accommodate the height of the third leg 22A, which includes a third foot 30A descents downwardly from an end of the second leg 22A. The third leg 22A is dimensioned vertically to accommodate the height of the fourth leg 24A, which if footless.

Two support arms 16A and 34A extend from the upright member 12A at respective levels above the collapsible leg arrangement 14A. Specifically, a first support arm 16A and a second support arm 34A extend from the upright member 12A at a first level and at a second level, respectively, above the leg arrangement 14A. In the depicted embodiment, the first support arm 16A is fixed on the upright member 12A, and the second support arm 34A is releasably mounted on the upright member 12A via a mounting bracket 36A at an end thereof. The first and second support arms 16A and 34A preferably extend in opposite directions.

The assembly 10A further includes first and second braces 38A extending, in the expanded position, from the upright member 12A at a point above the collapsible leg arrangement 14A to connection points on the third and fourth support legs 22A and 24A, respectively, outward of the upright member 12A. With the first and second braces 38A connected, the third and fourth support legs 22A and 24A extend from opposite sides of the upright member, both the third and fourth support legs 22A and 24A being offset 90 degrees from the first support leg 18A.

Figure 6:
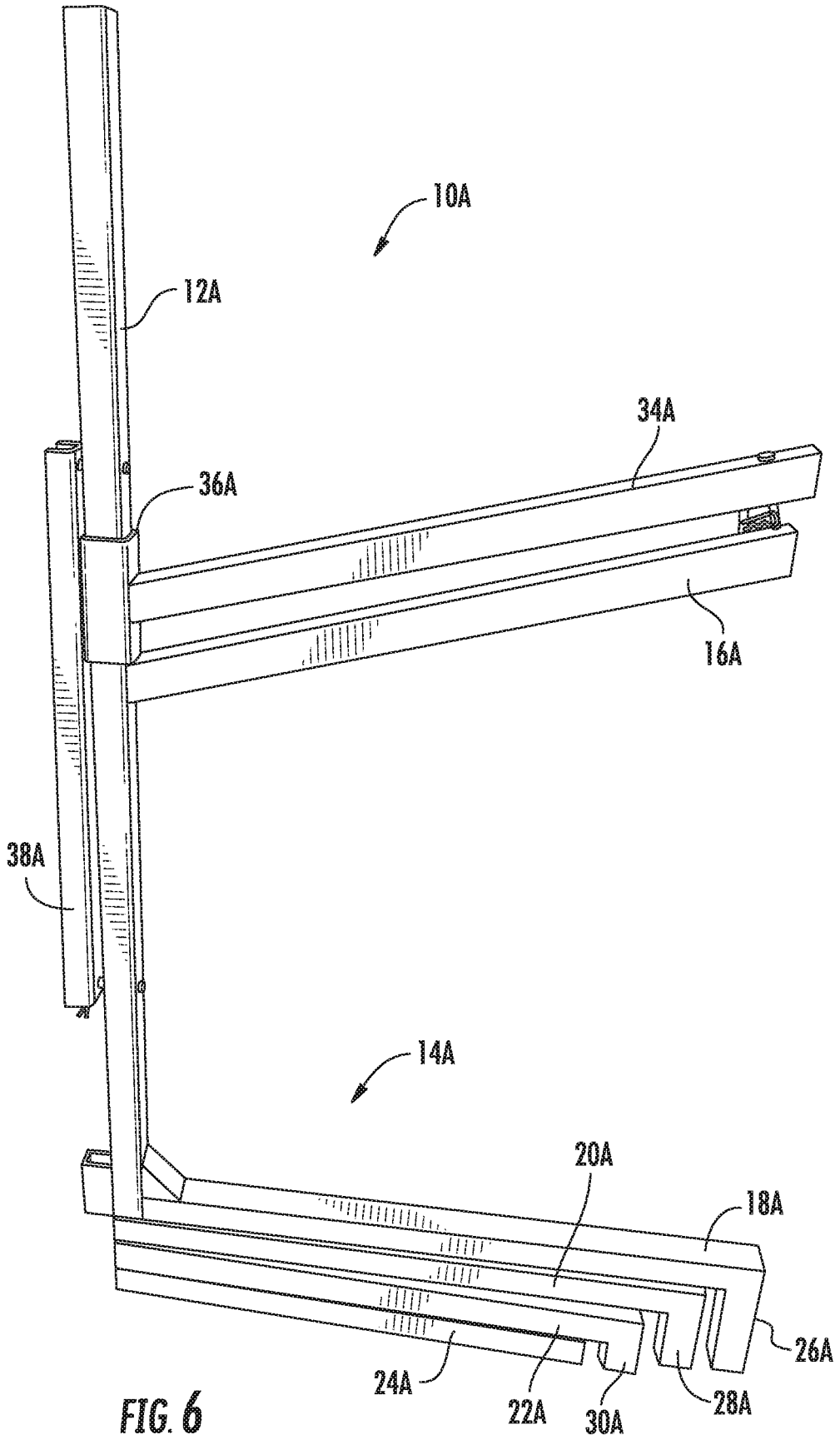
FIG. 6 is a side view of the collapsible support assembly of FIG. 5, in a collapsed position.

Referring to FIG. 6, the support assembly 10A is returned to a collapsed configuration when it is not in use, the second, third and fourth support legs 20A, 22A and 24A being rotated relative to the upright member 12A and toward the first support leg 18A until the same four support legs are nested under one another in the same plane. The support assembly 10A can thus be stored relatively flat for ease of transport and storage. The second support arm 34A can be removed from the upright member 12A and mounted to the upright member in alignment with the first support arm 16A. In the collapsed position, the first and second braces 38A are connected to the upright member 12A and extend in parallel therewith.

Figure 7:
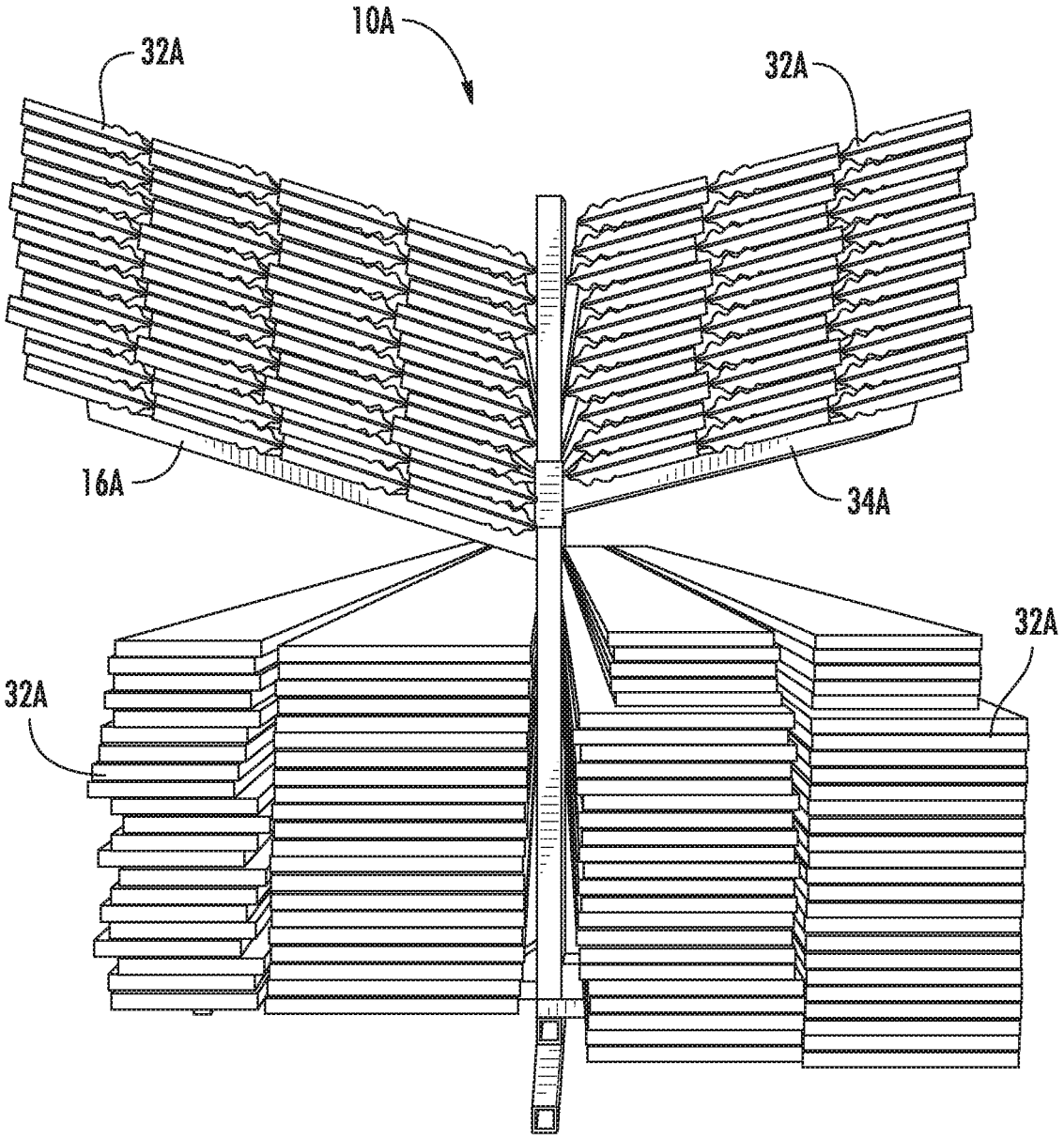
FIG. 7 is perspective view of a plurality of collapsible support assemblies of FIG. 5 in alignment to support a plurality of trim and molding pieces.

Referring to FIG. 7, a plurality of collapsible support assemblies 10A are aligned in respective working configurations in use. The plurality of support assemblies 10A are preferably substantially identical and aligned so as to support a plurality of elongated trim and molding pieces at one or more levels elevated above an underlying floor. In the depicted embodiment, the plurality of trim and molding 32A pieces are positioned on two support arms 16A and 34A and two support legs 18A and 20A.

The support assembly 10 and 10A can have any desired dimensions, making it suitable for a wide range of construction applications. Steel or other suitably durable and strong material is preferred.

Figure 8:
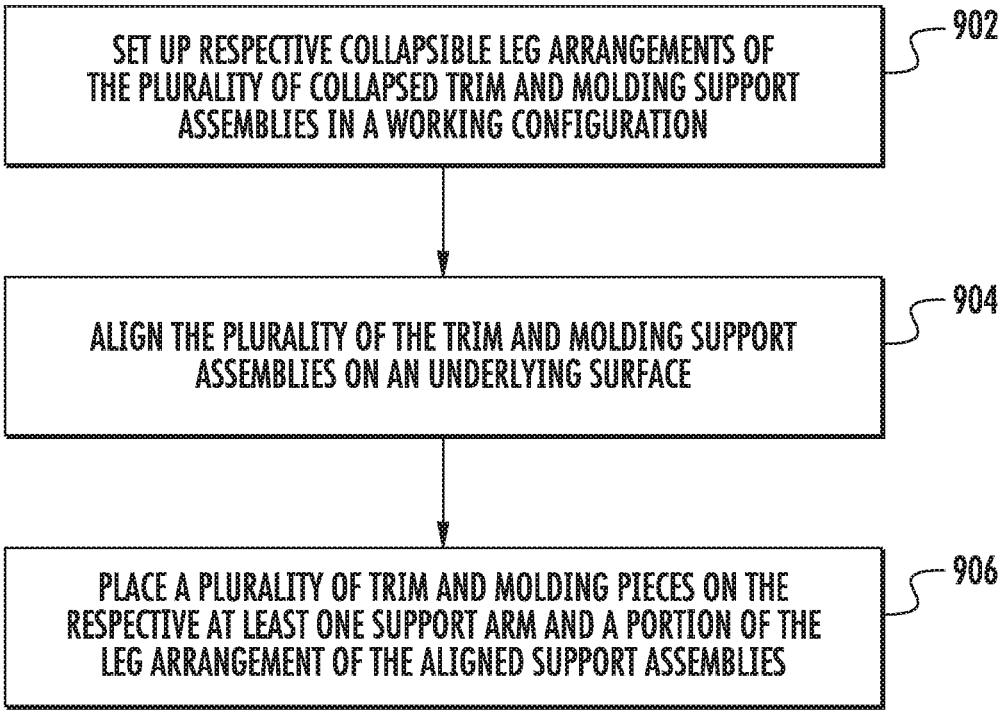
FIG. 8 is a flowchart illustrating a method of supporting and organizing trim molding pieces using a plurality of trim and molding support assemblies.

Referring to FIG. 8, a method of supporting and organizing trim molding pieces using a plurality of trim and molding support assemblies includes, at step 902, a plurality of collapsed trim and molding support assemblies are set up in respective expanded positions. At step 904, the plurality of the trim and molding support assemblies are aligned and spaced apart, either against a wall or elsewhere on a floor or other underlying surface. At step 906, a plurality of trim and molding pieces are placed on the respective at least first support arm and one or more support legs of the leg arrangement of the aligned support assemblies. When the support assemblies are no longer needed, they are readily collapsed for simple removal from the job site.

From the foregoing, it will be appreciated that the present invention affords an improved system and method for supporting trim and molding at a job site. In addition to protecting the trim and molding from environmental and/or other damage by elevating it off the floor, the safety of workers moving around the trim and molding is also enhanced. Additionally, the organization of the trim and molding is greatly improved, allowing both quicker and easier verification that the proper pieces have been delivered to the job site and facilitating subsequent use by finish carpenters.

The foregoing description of preferred embodiments is provided for illustrative and exemplary purposes; the present invention is not necessarily limited thereto. Rather, those skilled in the art will appreciate that various modifications, as well as adaptations for particular circumstances, are possible within the scope of the invention as herein shown and described.

What is claimed is:

1. A trim and molding support assembly comprising:

an upright member;

a collapsible leg arrangement connected to a lower end of the upright member, the collapsible leg arrangement including a plurality of support legs and having expanded and collapsed positions; and at least a first support arm extending outwardly from the upright member above the collapsible leg arrangement; and wherein, with the collapsible leg arrangement in the collapsed position, the plurality of support legs and the first arm all extend from a common side of the upright member;

wherein the first support arm extends from the upright member at a first level above the collapsible leg arrangement, and wherein the assembly further includes a second support arm extending from the upright member at a second level above the collapsible leg arrangement;

wherein the first support arm is fixed to the upright member and the second support arm is releasably mounted to the upright member;

wherein the first support arm and the second support arm extend in opposite directions in the expanded position; and wherein the first support arm and the second support arm extend in a same direction in the collapsed position.

2. The assembly of claim 1, wherein the plurality of support legs include a first support leg permanently fixed to extend from the common side the upright member and at least second and third support legs movable to extend from other sides of the upright member in the expanded position.

3. The assembly of claim 2, wherein the second and third support legs are nested under the first support leg in the collapsed position.

4. The assembly of claim 3, wherein the second support leg is rotatably connected to the upright member under the first support leg, and the third support leg is rotatably connected to the upright member under the second support leg.

5. The assembly of claim 4, wherein approximately 120 degree angle is formed between the first support leg and each of the second and third support legs in the expanded position.

6. The assembly of claim 4, wherein the plurality of support legs further includes a fourth support leg rotatably connected to the upright member under the third support leg.

7. The assembly of claim 6, wherein, in the expanded position, an approximately 90 degree angle is formed between the first support leg and each of the third and fourth support legs, the second support leg extends opposite the first support leg, and an approximately 90 degree angle is formed between the second support leg and each of the third and fourth support legs.

8. The assembly of claim 7, further comprising first and second braces extending, in the expanded position, from the upright member at a point above the collapsible leg arrangement to connection points on the third and fourth support legs, respectively, outward of the upright member.

9. The assembly of claim 8, wherein, in the collapsed position, the first and second braces are connected to the upright member and extend in parallel therewith.

10. A method of supporting and organizing trim molding pieces using a plurality of trim and molding support assemblies, wherein each trim and molding support assembly includes an upright member, a collapsible leg arrangement connected to a lower end of the upright member, the collapsible leg arrangement including a plurality of support legs and having expanded and collapsed positions, and at least a first support arm extending outwardly from the upright member above the collapsible leg arrangement, the method comprising:

setting up a plurality of collapsed trim and molding support assemblies in respective expanded configurations;

aligning the plurality of expanded trim and molding support assemblies on an underlying surface;

placing a plurality of trim and molding pieces on the first support arm and one or more of the plurality of support legs of the aligned support assemblies; and collapsing the plurality of trim and molding support assemblies once a construction job is finished wherein the collapsible leg arrangement further includes a second support arm extending from the upright member at a second level above the leg arrangement; and wherein collapsing the plurality of trim and molding support assemblies includes:

removing the second support arm extending from the upright member; and mounting the second support arm to the upright member in alignment with the first support arm such that the first support arm and the second support arm extend in a same direction in the collapsed position.

11. The method of claim 10, wherein collapsing the plurality of trim and molding support assemblies includes rotating one or more support legs of the leg arrangement under a first support leg.

12. The method of claim 10, wherein, with the collapsible leg arrangement in the collapsed position, the plurality of support legs and the first arm all extend from a common side of the upright member.

13. The method of claim 10, further comprising:

transporting the plurality of collapsed trim and molding support assemblies in the respective collapsed state.

* * * * *